US006064011A

United States Patent [19]

Amonett

[11] Patent Number: 6,064,011

[45] Date of Patent: May 16, 2000

[54] APPLIANCE TIMER HAVING AN AUXILIARY SWITCHING ASSEMBLY FOR INCREASING SWITCHING CAPACITY AND ASSOCIATED METHOD

[75] Inventor: Daniel K. Amonett, Marion County, Ind.

[73] Assignee: Emerson Electric Co., St. Louis, Mo.

[21] Appl. No.: 08/949,157

[22] Filed: Oct. 10, 1997

[51] Int. Cl.[7] ..... H01H 43/02

[52] U.S. Cl. ..... 200/11 DA; 200/37 R

[58] Field of Search ..... 200/11 A, 11 D, 200/11 DA, 11 G, 374, 38 B, 11 R–11 T, 33 R–41, 19.07, 19.08, 19.12, 19.13, 19.15, 19.18, 19.2, 6 BB; 361/748, 750; 428/458

[56] References Cited

U.S. PATENT DOCUMENTS

| | | | |
|---|---|---|---|
| 3,109,074 | 10/1963 | Lewis et al. | 200/38 R |
| 3,123,683 | 3/1964 | Lewis et al. . | |
| 3,213,216 | 10/1965 | Beck | 200/38 R |
| 3,736,390 | 5/1973 | Lockard | 200/11 DA |
| 3,845,256 | 10/1974 | Edwards . | |
| 4,268,339 | 5/1981 | Urban | 156/272 |
| 4,346,269 | 8/1982 | Slavin et al. . | |
| 4,346,271 | 8/1982 | Cushing | 200/38 R |
| 4,497,984 | 2/1985 | Ashman et al. . | |
| 4,625,084 | 11/1986 | Fowler et al. . | |
| 4,758,693 | 7/1988 | Hoffman . | |

*Primary Examiner*—Renee S. Luebke
*Attorney, Agent, or Firm*—Mark D. Becker

[57] ABSTRACT

A timer for controlling an appliance includes a housing. The timer also includes a camstack having a plurality of cam surfaces defined therein. The plurality of cam surfaces are positioned within the housing. The timer further includes a switch block which cooperates with the plurality of cam surfaces to provide switching operations for the appliance. Moreover, the timer includes an auxiliary member having a circuit pattern positioned on a side thereof. Rotation of the camstack causes rotation of the auxiliary member. The auxiliary member is positioned outside of the housing. The timer yet further includes a first switch arm positioned in contact with the side of the auxiliary member. Rotation of the auxiliary member causes the circuit pattern to be advanced into contact with the first switch arm. A method of controlling an appliance is also disclosed.

10 Claims, 5 Drawing Sheets

APPLIANCE TIMER HAVING AN AUXILIARY SWITCHING ASSEMBLY FOR INCREASING SWITCHING CAPACITY AND ASSOCIATED METHOD

TECHNICAL FIELD OF THE INVENTION

The present invention relates generally to appliance timers, and more specifically to an appliance timer having an auxiliary switching assembly for increasing switching capacity.

BACKGROUND OF THE INVENTION

Appliance timers are commonly used in many household appliances, such as dishwashers, clothes washers, and clothes dryers. The appliance timer controls operation of the appliance by actuating and deactuating switch assemblies which start and stop various work functions within the appliance such as a rinse function in the case of a clothes washer. The switch assemblies within the appliance timer are actuated and deactuated as a result of interaction between a number of cam surfaces defined in a camstack of the appliance timer and a number of cam followers which are respectively associated with the switch assemblies.

The switch assemblies are generally grouped into a number of switch blocks associated with the appliance timer. For example, one common switch block configuration includes eight switch assemblies. Moreover, each of the switch assemblies typically includes an upper circuit blade and a lower circuit blade, with an intermediate circuit blade positioned therebetween. The circuit blades are moved into and out of contact with one another in order to make and break, respectively, a number of circuits. In particular, if the circuit blade has a cam follower molded or otherwise secured thereto, the circuit blade may be moved into and out of contact with other circuit blades via cooperation with one of the cam surfaces defined in the camstack. Alternatively, if the circuit blade is configured without a cam follower, the circuit blade will remain stationary until another circuit blade associated with the switch assembly is moved into or out of contact therewith. One common switch assembly arrangement includes an upper and a lower switch blade each of which is configured without a cam follower. Actuation of the switch assembly occurs as an intermediate circuit blade, which has a cam follower secured thereto, is selectively lifted into contact with the upper circuit blade or dropped into contact with the lower circuit blade.

One way to categorize appliance timers is by the number of switch blocks included in the timer. For example, appliance timers may be categorized as either "single block" timers or "double block" timers. As their respective names suggest, a single block timer includes a single switch block (e.g. a single group of eight switch assemblies in operative contact with the camstack), whereas a double block timer includes two switch blocks (e.g. two groups of switch assemblies each having eight switch assemblies in operative contact with the camstack).

Single block timers advantageously have fewer components relative to double block timers thereby reducing costs associated with the appliance timer. Hence, a number of single block timers have heretofore been designed for use in many household appliances. Such single block timers are used in conjunction with appliances which do not require the additional switching capacity associated with double block timers. For example, it is known that approximately 85% of the clothes washer and dishwasher models available in the appliance market may be operated with a single block timer.

Therefore, use of single block timers in such appliances provides the switching capacity necessary to operate the appliance without the additional costs associated with double block timers.

However, the remaining models, often referred to as "high-end" models, generally must be controlled with a more complex timing device such as a double block timer. This is true since such high-end models generally have additional features associated therewith thereby increasing the number of switches required for operation of the appliance. As alluded to above, while use of such double block timers increases the switching capacity associated with the timer, costs associated with the timer are also increased thereby disadvantageously increasing costs associated with the appliance.

What is needed therefore is an appliance timer which has greater switching capacity relative to single block timers which have heretofore been designed. What is further needed is an appliance timer which has greater switching capacity relative to single block timers which have heretofore been designed, but has fewer components relative to double block timers which have heretofore been designed.

SUMMARY OF THE INVENTION

In accordance with a first embodiment of the present invention, there is provided a timer for controlling an appliance. The timer includes a camstack having a plurality of cam surfaces defined therein. The timer includes a switch block which cooperates with the plurality of cam surfaces to provide switching operations for the appliance. The timer includes an auxiliary member having a circuit pattern positioned on a side thereof. Rotation of the camstack causes rotation of the auxiliary member. The timer also includes a first switch arm positioned in contact with the side of the auxiliary member. Rotation of the auxiliary member causes the circuit pattern to be advanced into contact with the first switch arm.

In accordance with a second embodiment of the present invention, there is provided a method of controlling an appliance. The appliance includes a timer having (1) a camstack which includes a plurality of cam surfaces defined therein, (2) a switch block having a number of switch assemblies, (3) an auxiliary member having a circuit pattern positioned on a side thereof, and (4) a number of switch arms positioned in contact with the side of the auxiliary member. The method includes the step of rotating the camstack so as to cause the number of switch assemblies to cooperate with the plurality of cam surfaces so as to provide a first number of switching operations for the appliance. The method also includes the step of rotating the auxiliary member so as to cause the number of switch arms to cooperate with the circuit pattern so as to provide a second number of switching operations for the appliance.

In accordance with a third embodiment of the present invention, there is provided a timer for controlling an appliance. The timer includes a housing. The timer also includes a camstack having a plurality of cam surfaces defined therein. The plurality of cam surfaces are positioned within the housing. The timer further includes a switch block which cooperates with the plurality of cam surfaces to provide switching operations for the appliance. Moreover, the timer includes an auxiliary member having a circuit pattern positioned on a side thereof. Rotation of the camstack causes rotation of the auxiliary member. The auxiliary member is positioned outside of the housing. The timer yet further includes a first switch arm positioned in contact with the side of the auxiliary member. Rotation of the auxiliary member causes the circuit pattern to be advanced into contact with the first switch arm.

It is therefore an object of the present invention to provide a new and useful timer for controlling an appliance.

It is a further object of the present invention to provide an improved timer for controlling an appliance.

It is moreover an object of the present invention to provide a new and useful method of controlling an appliance.

It is yet further an object of the present invention to provide an improved method of controlling an appliance.

It is also an object of the present invention to provide an appliance timer that includes an auxiliary switching assembly for increasing the switching capacity associated with the timer.

It is moreover an object of the present invention to provide an appliance timer that utilizes fewer components relative to appliance timers which have heretofore been designed.

It is yet further an object of the present invention to provide an auxiliary switching assembly which may be retrofit to an existing timer thereby increasing the switching capacity associated with the existing timer.

The above and other objects, features, and advantages of the present invention will become apparent from the following description and the attached drawings.

DETAILED DESCRIPTION OF THE INVENTION

Figure 1:
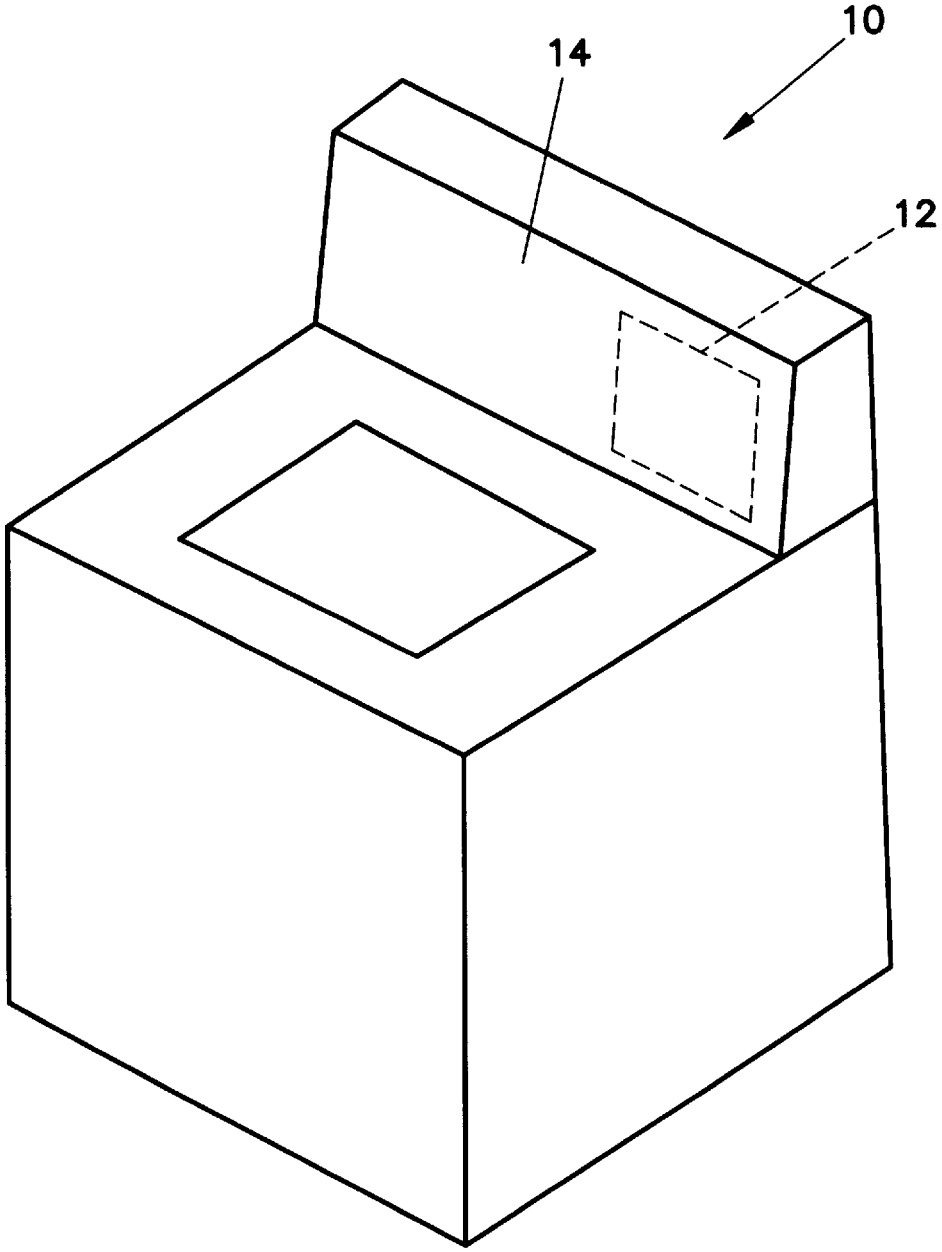
FIG. 1 is a perspective view of an appliance which includes an appliance timer which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown an appliance 10 which is a clothes washing machine. The appliance 10 includes an appliance timer 12. The appliance timer 12 is secured to a console 14 of the appliance 10. The appliance timer 12 controls various work functions associated with the appliance 10. Examples of such work functions include agitation, washing, spinning, drying, dispensing detergent or fabric softener, hot water filling, cold water filling, and water draining.

Referring now to FIGS. 2–8, there is shown the appliance timer 12 in more detail. The appliance timer 12 includes a housing member 16, a side plate 18, a top plate 20, a switch block 22, a camstack 24, and an auxiliary switching assembly 26. The housing member 16, the side plate 18, and the top plate 20 cooperatively define a housing of the appliance timer 12.

Figure 2:
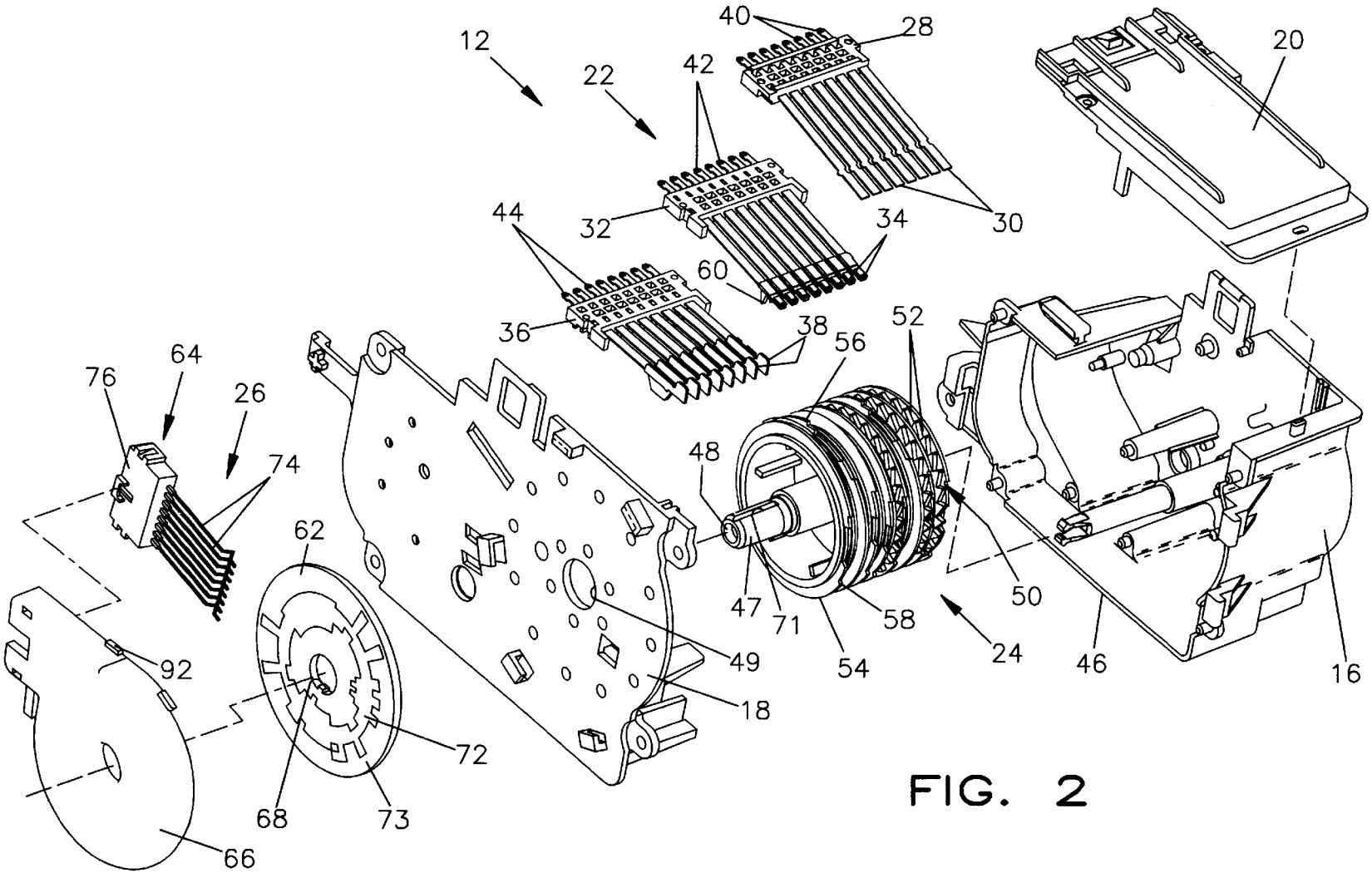
FIG. 2 is an exploded perspective view of the appliance timer of the appliance of FIG. 1 (note that a number of the components associated with the appliance timer have been removed for clarity of description)
Figure 3:
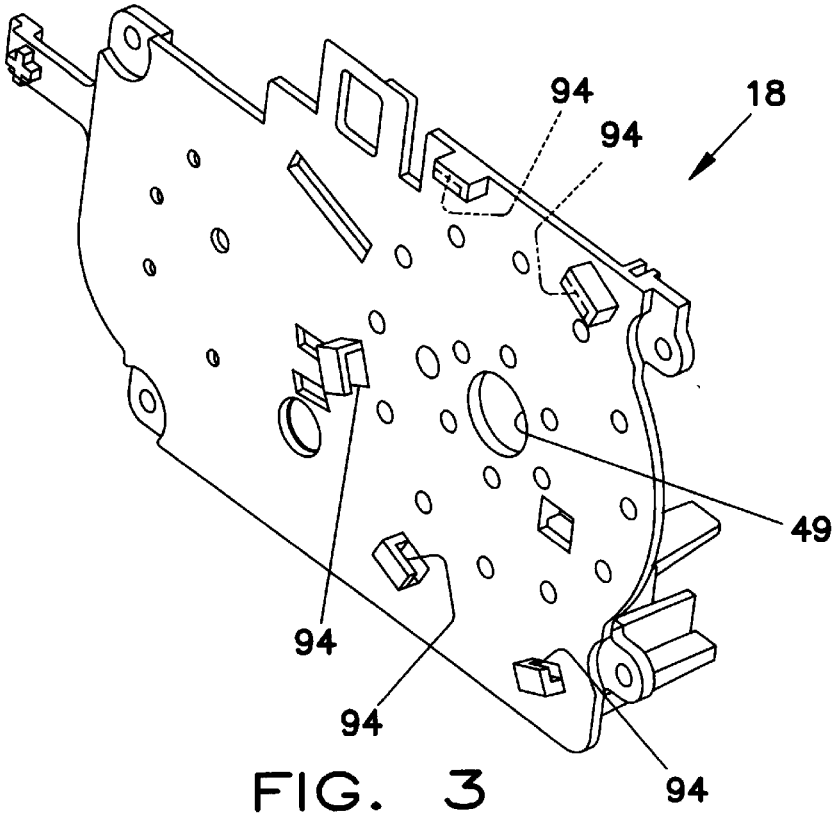
FIG. 3 is an enlarged perspective view of the side plate of the housing of the appliance timer of FIG. 2.

The switch block 22 preferably includes a number of switch assemblies. More specifically, the switch block 22 includes an upper switch wafer 28 having a number of upper circuit blades 30 secured thereto, an intermediate switch wafer 32 having a number of intermediate circuit blades 34 secured thereto, and a lower switch wafer 36 having a number of lower circuit blades 38 secured thereto. The circuit blades 30, 34, 38 are preferably insert molded into the switch wafers 28, 32, 36, respectively. One end of each of the circuit blades 30, 34, 38 protrudes outwardly from the switch wafers 28, 32, 36, respectively, thereby defining electrical terminals 40, 42, 44, respectively, as shown in FIG. 2. The terminals 40, 42, 44 are electrically coupled to components associated with the appliance 10 such as a main machine motor (not shown) and a heater (not shown).

The camstack 24 is secured to a control shaft 46. In particular, the camstack 24 includes a hub 47 having a central bore 48 defined therein. The control shaft 46 is received through the central bore 48 in order to be secured to the camstack hub 47. One manner of securing the camstack hub 47 to the control shaft 46 is with a clutch mechanism (not shown). The camstack 24 rotates relative to the side plate 18. In particular, the side plate 18 has an aperture 49 defined therein (see FIG. 3). A first end of the camstack hub 47 is received through the aperture 49 thereby allowing the camstack hub 47 and hence the camstack 24 to rotate relative to the side plate 18.

The camstack 24 also includes a number of drive blades 50. Each of the drive blades 50 has a group of ratchet teeth 52 defined therein. The ratchet teeth 52 cooperate with a number of drive pawls (not shown) in order to provide for rotation of the camstack 24.

Moreover, the camstack 24 includes a number of program blades 54. The program blades 54 have a number of cam lifts 56 and a number of cam drops 58 defined therein. The drive blades 50 are non-rotatably coupled to each of the program blades 54. More specifically, rotation of any of the drive blades 50 causes rotation of each of the program blades 54.

Each of the intermediate circuit blades 34 has a cam follower 60 molded or otherwise secured thereto. The cam followers 60 cooperate with the program blades of the camstack 24 as the camstack 24 is rotated thereunder in order to selectively make and/or break a number of electrical circuits. For example, during rotation of the camstack 24, one of the cam lifts 56 may be rotated into contact with a given cam follower 60 thereby causing the intermediate circuit blade 34 associated therewith to be lifted or otherwise urged into contact with a corresponding upper circuit blade 30. Similarly, during rotation of the camstack 24, one of the cam drops 58 may be rotated into contact with a given cam follower 60 thereby causing the intermediate circuit blade 34 associated therewith to be dropped or otherwise urged into contact with a corresponding lower circuit blade 38.

The appliance timer 12, as described, is a single block timer. More specifically, the camstack 24 is configured to include a predetermined number of the program blades 54 which are necessary to control a single switch block (i.e. the switch block 22). It should be appreciated that if additional switch blocks are added to the appliance timer 12, additional program blades 54 would likewise have to be added to the camstack 24 thereby undesirably increasing costs associated with the appliance timer 12.

The auxiliary switching assembly 26 is included in the appliance timer 12 to provide additional switching capacity without the need for such an additional switch block. The auxiliary switching assembly 26 may be used in conjunction with a number of commercially available appliance timers. For example, the auxiliary switching assembly 26 may be used in conjunction with a model M620 Delta Timer having slight modifications thereto. The model M620 Delta Timer is commercially available from Mallory Controls of Indianapolis, Ind.

Figure 4:
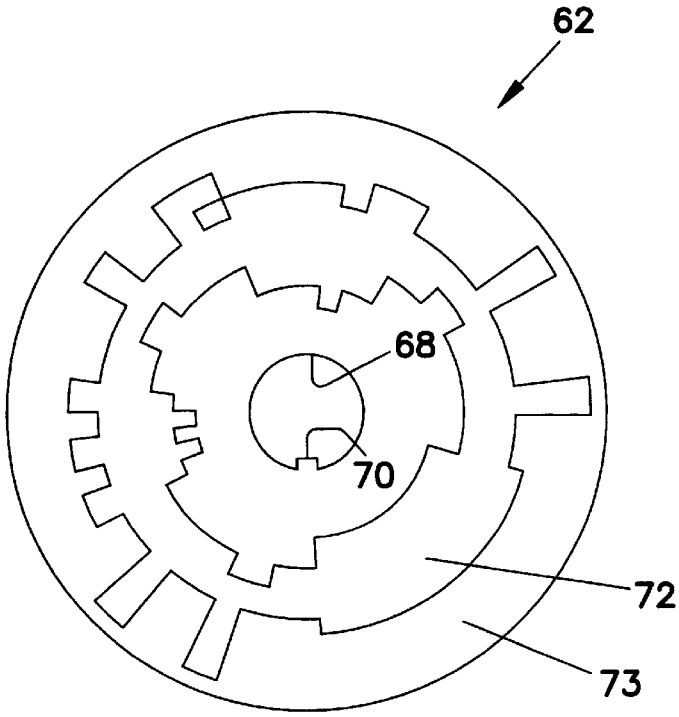
FIG. 4 is an enlarged top elevational view of the auxiliary member of the appliance timer of FIG. 2.

The auxiliary switching assembly 26 includes an auxiliary member 62, an auxiliary switch wafer assembly 64, and an auxiliary cover 66. As shown in FIG. 4, the auxiliary member 62 is substantially circular in shape, and has an aperture 68 defined therein. Moreover, the auxiliary member 62 has a keying member or tab 70 defined therein. The aperture 68 and the keying tab 70 are provided to secure the auxiliary member 62 to the hub 47 of the camstack 24 (see FIG. 2). In particular, the camstack hub 47 is received through the aperture 68 such that the keying tab 70 is secured within a keying member or slot 71 defined in the camstack hub 47 thereby non-rotatably securing the auxiliary member 62 to the camstack hub 47. While the above keying configuration has numerous advantages associated therewith, certain of these advantages may be achieved with other keying configurations. For example, a keying slot may be defined in the auxiliary member 62 with a corresponding keying tab defined in the camstack hub 47 thereby allowing the auxiliary member 62 to be non-rotatably secured to the camstack 24 when the camstack hub 47 is received through the aperture 68.

It should also be appreciated that securing the auxiliary member 62 to the camstack hub 47 via use of the keying tab 70 and the keying slot 71 causes the auxiliary member 62 to rotate dependently with the camstack 24. More specifically, as the drive pawls (not shown) of the appliance timer 12 drive the camstack 24 at a predetermined speed, the auxiliary member 62 is likewise driven at the same predetermined speed. Moreover, it should be appreciated that the camstack 24 and the auxiliary member 62 are rotated the same distance over a given period of time. In particular, if the drive pawls of the appliance timer 12 drive the camstack 24 a distance corresponding to one complete revolution thereof, the auxiliary member 62 will likewise be driven a distance corresponding to one complete revolution thereof.

Moreover, it should be noted that the auxiliary member 62 is secured to the camstack hub 47 such that the auxiliary member 62 is positioned outside the housing (i.e. the housing member 16, the side plate 18, and the top plate 20) of the appliance timer 12. Conversely, the camstack 24 (except for the portion of the hub 47 which extends through the aperture 49) is positioned inside the housing of the appliance timer 12.

The auxiliary member 62 is preferably made of a common circuit board material, such as an epoxy or a phenolic resin, and has a circuit pattern 72 on a front side 73 thereof. The circuit pattern 72 may be printed and/or etched onto the auxiliary member 62 with copper or other suitable foil material. The copper foil of the circuit pattern 72 may have a thin layer of material plated or otherwise disposed thereon in order to prevent oxidation of the foil. For example, the copper foil may have a thin layer of nickel plating thereon, or may be coated with a thin layer of a protective lubricant.

Figure 5:
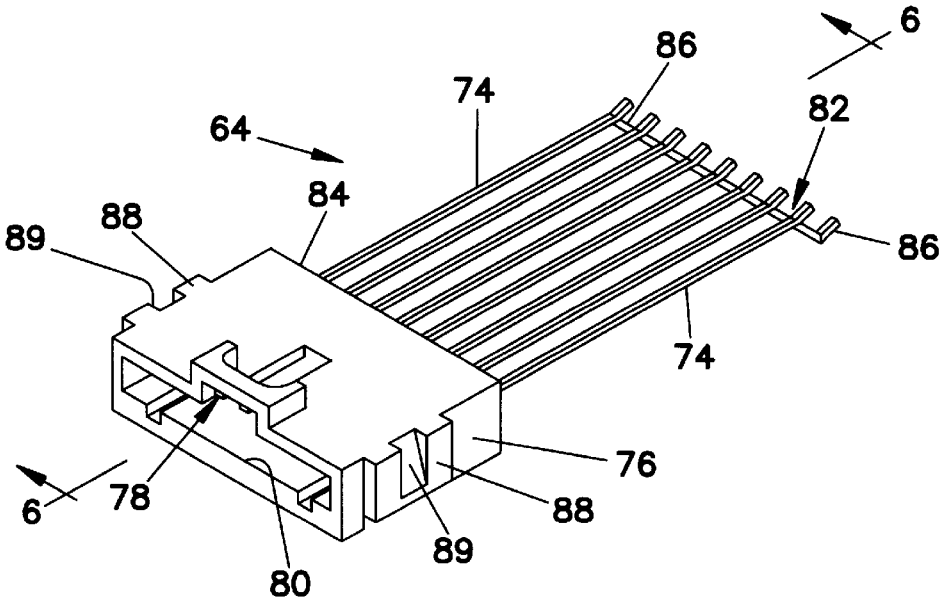
FIG. 5 is an enlarged perspective view of the switch wafer assembly of the appliance timer of FIG. 2.
Figure 6:
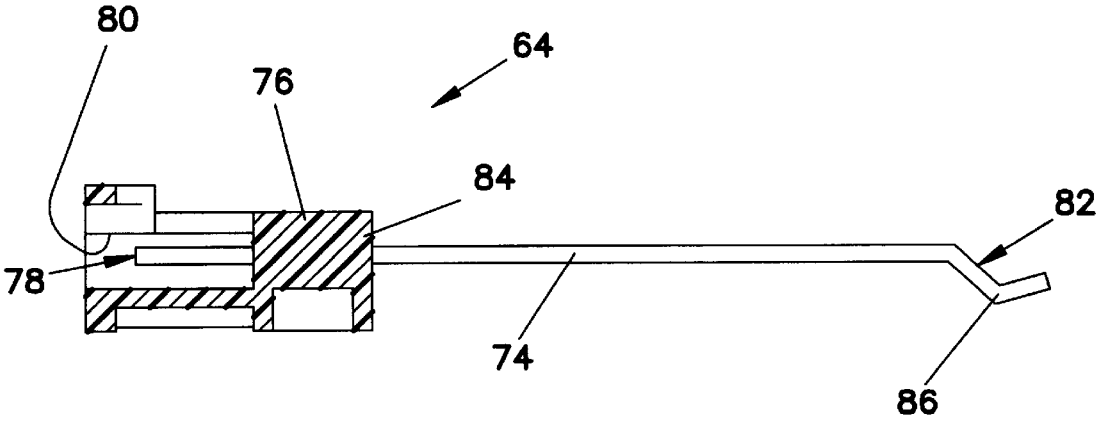
FIG. 6 is an enlarged cross sectional view of the switch wafer assembly taken along the line 6—6 of FIG. 5, as viewed in the direction of the arrows.
Figure 7:
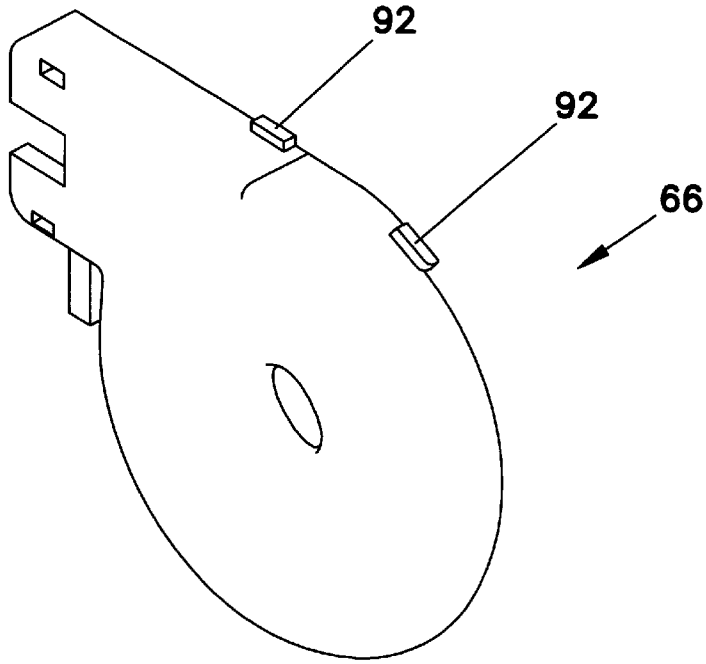
FIG. 7 is an enlarged perspective view showing the exterior surface of the auxiliary cover of the appliance timer of FIG. 2.
Figure 8:
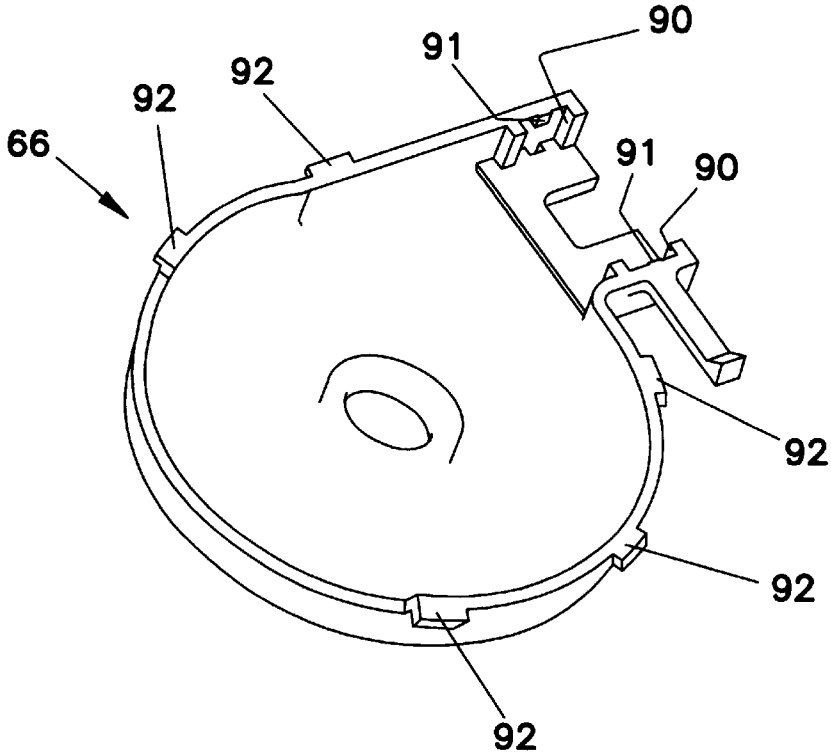
FIG. 8 is a view similar to FIG. 7, but showing the interior surface of the auxiliary cover of the appliance timer of FIG. 2.

As shown in FIGS. 5 and 6, the switch wafer assembly 64 includes a number of copper switch blades or arms 74, and an auxiliary base or wafer 76. The switch arms 74 are secured in the auxiliary wafer 76 such that a first end 78 of each of the switch arms 74 is positioned within an open ended chamber 80 defined in the auxiliary wafer 76, and a second end 82 of each of the switch arms 74 extends outwardly from an outer wall 84 of the auxiliary wafer 76. The switch arms 74 may be secured to the auxiliary wafer 76 in a number of different manners. For example, the switch arms 74 may be insert molded into the auxiliary wafer 76.

The first end 78 of each of the switch arms 74 defines an electrical terminal which may be electrically coupled to one of the various components associated with the appliance 10. In the preferred embodiment, the auxiliary switching assembly 26 is configured to provide for the switching of a number of light duty circuits (e.g. circuits which carry a current of less than 2 amperes) associated with the appliance 10. For example, the auxiliary switching assembly 26 may be used to provide switching operations for the circuits that operate a number of indicator lights (not shown) or electrically-actuated water valves (not shown) associated with the appliance 10. Conversely, the switch assemblies associated with the switch block 22, as alluded to above, provide for the switching of a number of standard or heavy duty circuits (e.g. circuits which carry a current of 13–15 amperes) associated with the appliance 10. For example, the switch block 22 may be used to provide switching operations for the circuits that operate the main machine motor (not shown) or the heater (not shown) associated with the appliance 10. It should however be appreciated that the auxiliary switching assembly 26 could alternatively be configured, with only slight modification thereof, to provide for switching of standard or heavy duty circuits.

Moreover, the first or terminal end 78 of each of the switch arms 74 is positioned relative to one another within the auxiliary wafer 76 such that the auxiliary wafer 78 may mate or otherwise be coupled to known, industry-standard "quick connecting" mating plugs (not shown) when the appliance timer 12 is electrically coupled to the appliance 10. One mating plug which may be connected to the auxiliary wafer 76 is a model number 70058-0222 Mating Plug which is commercially available from Molex, Incorporated of Downers Grove, Ill.

The switch arms 74 are biased into contact with the front side 73 of the auxiliary member 62 during rotation thereof. In particular, the second end 82 of each of the switch arms 74 is formed so as to define a contact follower 86. Each of the contact followers 86 contacts the front side 73 of the auxiliary member 62 in order to selectively position the switch arms 74 into and out of contact with the circuit pattern 72 as the auxiliary member 62 is rotated. In particular, each of the switch arms 74 is positionable between a pattern contact position and a pattern non-contact position. It should be appreciated that the contact follower 86 of the switch arm 74 contacts the circuit pattern 72 when the switch arm 74 is positioned in the pattern contact position, whereas the contact follower 86 of the switch arm 74 is spaced apart from the circuit pattern 72 when the switch arm 74 is positioned in the pattern non-contact position. Hence, a first switch arm 74 is electrically coupled to a second switch arm 74 if both the first switch arm 74 and second switch arm 74 are positioned in their respective pattern contact positions. However, if either of the first switch arm 74 or the second switch arm 74 is positioned in their respective pattern non-contact position, the first switch arm 74 is electrically isolated from the second switch arm 74.

The circuit pattern 72 may be configured to selectively electrically couple and/or isolate the switch arms 74 from one another so as to define a switching program. Hence, by varying the configuration of the circuit pattern 72, a number of different switching configurations may be created. For example, in the case of where eight (8) switch arms 74 are included in the switch wafer assembly 64, the auxiliary switching assembly 26 may function as four (4) isolated switches, or seven (7) common single-pole-single-throw (SPST) switches.

As discussed above, in the preferred embodiment, the auxiliary switching assembly 26 provides for the switching of light duty circuits. Hence, the magnitude of the contact force necessary between the contact followers 86 and the front side 73 of the auxiliary member 62 is relatively small thereby facilitating manual setting of the appliance timer 12. In particular, such small contact force allows the auxiliary member 62 to be rotated in either the clockwise or counterclockwise direction without the need to lift or otherwise move the contact followers 86 out of contact with the front side 73 of the auxiliary member 62 thereby facilitating bidirectional manual setting of the appliance timer 12. Moreover, such small contact force allows the contact followers 86 to move relative to the front side 73 of the auxiliary member 62 in a relatively quiet manner during manual setting of the appliance timer 12 thereby eliminating the need for a mechanism to lift or otherwise move the contact followers 86 out of contact with the auxiliary member 62.

The auxiliary cover 66 aligns the switch arms 74 relative to the circuit pattern 72. In particular, the auxiliary wafer 76 has a pair of locating members or tabs 88 defined therein, whereas the auxiliary cover 66 has a pair of locating members or notches 90 defined therein. Moreover, the locating tabs 88 are snap fit or otherwise secured within the locating notches 90. In particular, each of the tabs 88 of the auxiliary wafer 76 has a ramped cavity 89 defined therein, whereas the auxiliary cover 66 has a pair of locking tabs 91 defined therein. As the locating tabs 88 are advanced into the locating notches 90, the locking tabs 91 cooperate with the ramped cavities 89 so as to snap fit the auxiliary wafer 76 to the auxiliary cover 66.

Thereafter, a number or attaching tabs 92 defined in the auxiliary cover 66 (see FIGS. 7 and 8) may be snap fit or otherwise secured within a corresponding number of attaching slots 94 (see FIG. 3) defined in the side plate 18 thereby securing the auxiliary cover 66 and hence the switch wafer assembly 64 to the side plate 18. It should be appreciated that the position of (1) the locating tabs 88 relative to the locating notches 90, and (2) the attaching tabs 92 relative to their respective attaching slots 94 is predetermined such that when the auxiliary switching assembly 26 is assembled (i.e. secured to the housing of the appliance timer 12), the contact followers 86 of each of the switch arms 74 are aligned in their respective predetermined positions in order to be accurately located relative to the circuit pattern 72 as it is rotated thereunder. While the above locating configuration has numerous advantages associated therewith, certain of these advantages may be achieved with other locating configurations. For example, a number of locating notches may be defined in the auxiliary wafer 76 with a corresponding number of locating tabs defined in the auxiliary cover 66 thereby allowing the switch wafer assembly 64 to be aligned with the auxiliary member 62 when the auxiliary cover 66 and hence the switch wafer assembly 64 are secured to the side plate 18.

As described above, the auxiliary switching assembly 26 increases the switching capacity associated with the appliance timer 12 without the need for an additional switch block (i.e. without the need for two (2) switch blocks 22) to be present in the appliance timer 12. Such an increase in switching capacity may be useful for future appliance timer designs which may have increased switching demands. In addition, the auxiliary switching assembly 26 may be a retrofit to existing single block timer designs, such as the model M620 Delta Timer available from Mallory Controls. The use of the auxiliary switching assembly 26 as a retrofit provides an appliance timer with increased switching capacity relative to an existing single block timer, without the costs associated with a double block timer.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

It should be appreciated that although the auxiliary switching assembly 26 is herein described as being used in conjunction with a single block timer, the auxiliary switching assembly may also be used in conjunction with other types of timers. For example, the auxiliary switching assembly 26 may be used to increase the switching capacity of a double block timer.

What is claimed is:

1. A timer for controlling an appliance, comprising:

a camstack having a plurality of cam surfaces defined therein;

a switch block which cooperates with said plurality of cam surfaces to provide switching operations for the appliance;

an auxiliary member having a circuit pattern positioned on a side thereof, wherein rotation of said camstack causes rotation of said auxiliary member; and a first switch arm positioned in contact with said side of said auxiliary member wherein rotation of said auxiliary member causes said circuit pattern to be advanced into contact with said first switch arm, and;

a housing wherein said plurality of cam surfaces of said camstack are positioned within said housing, and said auxiliary member is positioned outside said housing.

2. A timer for controlling an appliance, comprising:

a camstack having a plurality of cam surfaces defined thereon;

a first switch assembly which cooperates with said plurality of cam surfaces to provide switching operations for the appliance;

an auxiliary member having a circuit pattern positioned on a side thereof, being non-rotatably mounted to said camstack wherein rotation of said camstack causes rotation of said auxiliary member; and an auxiliary switch assembly having a plurality of switch arms positioned in contact with said side of said auxiliary member wherein rotation of said auxiliary member causes said circuit pattern to be advanced into contact with said plurality of switch arms to provide additional switching operations for the appliance, a housing enclosing the camstack and the first switch assembly; and, an auxiliary housing fixedly mounted to an external surface of said housing, wherein said auxiliary member Is positioned internal to the auxiliary housing and external to the housing.

3. The timer of claim 2 wherein the auxiliary switch assembly is fixedly mounted to the auxiliary housing and positioned external to the housing.

4. A timer for controlling an appliance, comprising:

a housing;

a camstack having a plurality of cam surfaces defined therein, said plurality of cam surfaces being positioned within said housing;

a switch block which cooperates with said plurality of cam surfaces to provide switching operations for the appliance;

an auxiliary member having a circuit pattern positioned on a side thereof, wherein (1) rotation of said camstack causes rotation of said auxiliary member, and (2) said auxiliary member is positioned outside of said housing; and a first switch arm positioned in contact with said side of said auxiliary member, wherein rotation of said auxiliary member causes said circuit pattern to be advanced into contact with said first switch arm.

5. The timer of claim 4, wherein:

said auxiliary member is secured to said camstack so as to rotate dependently therewith.

6. The timer of claim 5, wherein:

said camstack includes a hub, said hub has a first keying member, said auxiliary member has a second keying member, and said first keying member cooperates with said second keying member so as to cause said auxiliary member to rotate dependently with said camstack.

7. The timer of claim 4, further comprising a second switch arm positioned in contact with said auxiliary member, wherein rotation of said auxiliary member causes said circuit pattern to be advanced into contact with said second switch arm, and wherein:

said first switch arm is electrically coupled to said second switch arm when (1) said first switch arm contacts said circuit pattern, and (2) said second switch arm contacts said circuit pattern.

8. The timer of claim 7, wherein:

said first switch arm is electrically isolated from said second switch arm when (1) said first switch arm is spaced apart from said circuit pattern, or (2) said second switch arm is spaced apart from said circuit pattern.

9. The timer of claim 4, further comprising:

an auxiliary base having (1) said switch arm secured thereto, and (2) a first locating member; and an auxiliary cover having a second locating member, said first locating member cooperates with said second locating member so as to position said switch arm relative to said circuit pattern.

10. The timer of claim 4, wherein:

said auxiliary member includes a circuit board, and said circuit pattern includes a copper foil supported by said circuit board.

* * * * *